United States Patent [19]

Roth et al.

[11] Patent Number: 4,462,792

[45] Date of Patent: Jul. 31, 1984

[54] REHEATING METAL BODIES WITH RECOVERED BLAST-FURNACE ENERGY

[75] Inventors: Jean-Luc Roth; Herve Sierpinski, both of Metz, France

[73] Assignee: Institut de Recherches de la Sigerurgie Francaise, Saint Germain-en-Laye, France

[21] Appl. No.: 417,831

[22] Filed: Sep. 13, 1982

Related U.S. Application Data

[63] Continuation-in-part of Ser. No. 415,828, Sep. 7, 1982.

[30] Foreign Application Priority Data

Sep. 7, 1981 [FR] France ..... 81 17053

[51] Int. Cl.[3] ..... F27D 3/00; F23D 13/20; C21B 9/00

[52] U.S. Cl. ..... 432/11; 373/18; 266/140; 431/5; 432/29

[58] Field of Search ..... 431/5; 219/121 P; 373/18; 432/29, 221, 11; 266/138, 140, 141

[56] References Cited

U.S. PATENT DOCUMENTS

| | | | |
|---|---|---|---|
| 3,049,300 | 8/1962 | Lewis et al. | 431/5 |
| 3,148,868 | 9/1964 | Sidwell | 266/141 |
| 3,715,110 | 2/1973 | Jensen et al. | 432/29 |
| 3,970,290 | 7/1976 | Santen et al. | 373/18 |

*Primary Examiner*—John J. Camby
*Attorney, Agent, or Firm*—Michael J. Striker

[57] ABSTRACT

Metal bodies such as billets and blooms are reheated for rolling in a metal-refining operation having a blast furnace by first heating the top gas of the blast furnace to at least 800° C. by means of a plasma torch, then, before the gas has cooled appreciably, burning the heated top gas in a preheating chamber. The metal bodies are exposed in the preheating chamber to the heat of the burning and heated top gas. The heated top gas is mixed with combustion-inducing gas to burn it. Before it is mixed with the heated top gas it is preheated by heat exchange with combustion-product gas withdrawn from the preheating chamber. In this manner it is possible to raise the temperature of this combustion-inducing gas to at least 600° C., so that the burners firing the preheating chamber burn clean. In addition much of the heat of the process is recovered, again reducing energy costs for the system.

8 Claims, 1 Drawing Figure

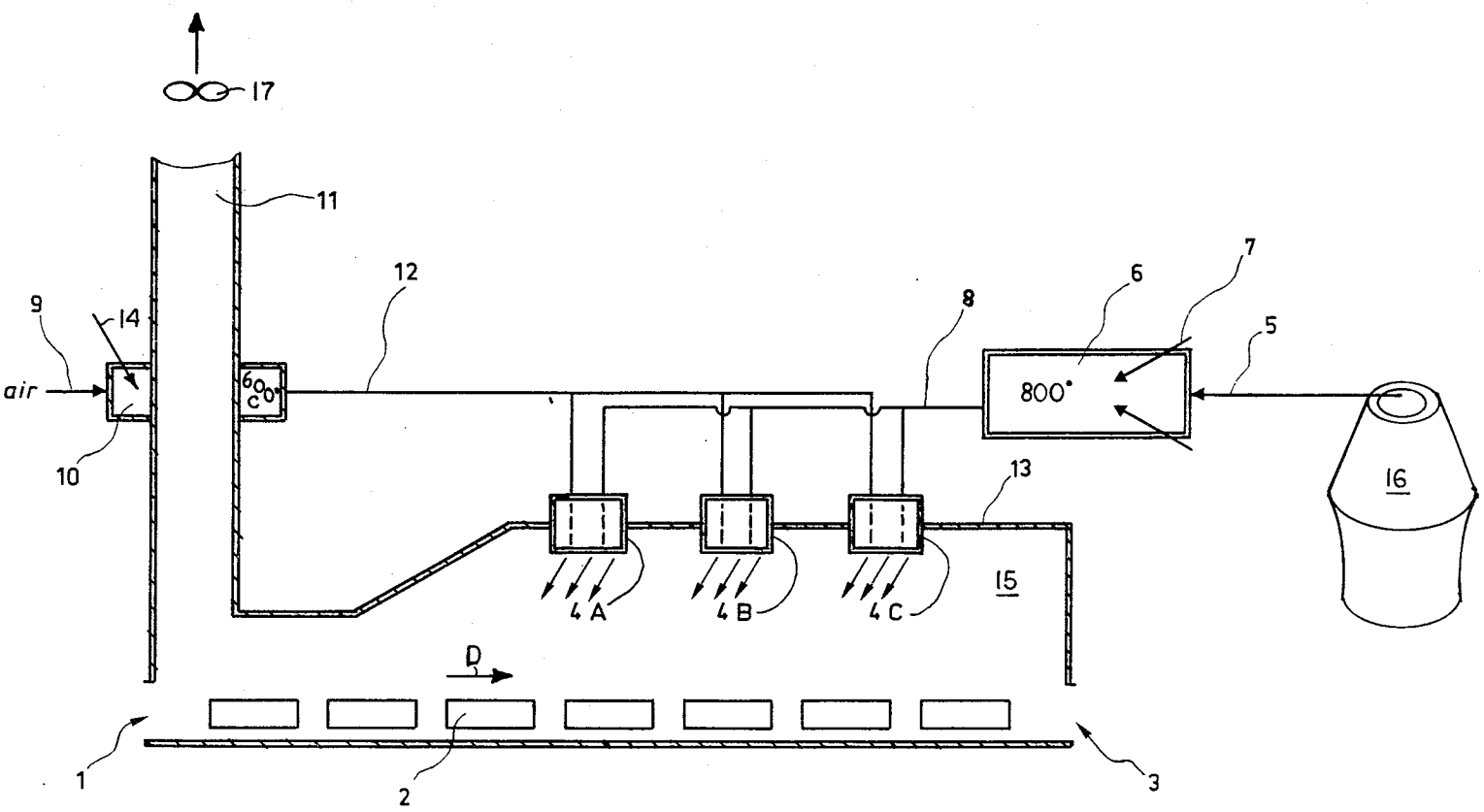
16
5
7
6
800°
8
13
15
3
4C
4B
4A
D
2
12
11
600°C
17
14
10
9
air
1

REHEATING METAL BODIES WITH RECOVERED BLAST-FURNACE ENERGY

CROSS-REFERENCE TO RELATED APPLICATION

This application is a continuation-in-part application of our copending application Ser. No. 415,828, filed Sept. 7, 1982 and entitled A PROCESS FOR SUPPLYING POWER TO A HEATING FURNACE FOR METALLURGICAL PRODUCTS.

FIELD OF THE INVENTION

The present invention relates to a method of reheating metal bodies such as ingots, billets, blooms and the like. More particularly this invention concerns the reheating of iron or steel bodies before rolling same in a large-scale smelting operation having a blast furnace.

BACKGROUND OF THE INVENTION

Before rolling a metal body, such as an iron ingot, it must be heated to about 1200° C. This is done in reheating chambers through which the bodies pass, the heat being created by heavy-duty burners. The burners typically run on coke gas or fuel oil, and consume enormous amounts of whatever combustible they are using. Hence operating such a system is extremely expensive.

OBJECTS OF THE INVENTION

It is therefore an object of the present invention to provide an improved method of reheating metal bodies.

Another object is the provision of such a method of reheating metal bodies, normally for subsequent rolling, which overcomes the above-given disadvantages.

A further object is to provide an improved system for firing a reheating chamber in a combined rolling mill and smelting plant having a blast furnace.

SUMMARY OF THE INVENTION

These objects are attained according to the instant invention in a method of reheating metal bodies such as billets and blooms in a metal-refining operation having a blast furnace which basically comprises the steps of heating the top gas of the blast furnace to at least 800° C. by means of a plasma torch, then, before the gas has cooled appreciably, burning the heated top gas in the reheating chamber. The metal bodies are exposed in the reheating chamber to the heat of the burning and heated top gas.

Thus the instant invention is based on the use of combustible gas of low caloric energy, in this case blast-furnace top gas, which is plentiful and cheap. Once heated with the plasma torch it burns well, creating a flame having a temperature of around 1800° C., which is about what a high-energy combustible would yield. What is more the system disposes of the blast-furnace top gas, whose carbon-monoxide component prevents it from being discharged into the atmosphere without some form of afterburning.

According to another feature of this invention the heated top gas is mixed with combustion-inducing gas to burn it. Before this combustion-inducing gas is mixed with the heated top gas it is preheated by heat exchange with combustion-product gas withdrawn from the preheating chamber. In this manner it is possible to raise the temperature of this combustion-inducing gas to at least 600° C., so that the burners firing the reheating chamber burn clean. In addition much of the heat of the process is recovered, again reducing energy costs for the system.

This combustion-inducing gas is normally ambient air. It can also be preheated before it is mixed with the heated top gas by means of a plasma torch.

The bodies are exposed in the chamber by being passed in a transport direction through the chamber. The burning heated top gas is directed as a flame at the bodies countercurrent to the transport direction of same, and combustion-product gas is withdrawn from the reheating chamber from the upstream end thereof relative to the transport direction of the bodies. Thus flame and gas flow in the heating chamber runs from downstream to upstream relative to the transport direction, that is countercurrent to them.

DESCRIPTION OF THE DRAWING

The above and other features and advantages will become more readily apparent from the following, reference being made to the accompanying drawing whose sole FIGURE is a schematic representation of the system of this invention.

SPECIFIC DESCRIPTION

As seen in the drawing a succession of blooms 2 are passed in a transport direction D from the entrance 1 to the exit 3 of a heating chamber 15 having a roof 13. Three burners 4A, 4B, and 4C are mounted in this roof 13, directed upstream against the direction D.

An adjacent blast furnace 16 has its top gas, with a usable CO content, fed via a conduit 5 to a preheating chamber 6 provided with plasma torches 7 that raise its temperature to at least 800° C. Thence the heated top gas is fed via a branched conduit 8 to the individual burners 4A, 4B, and 4C mounted in the top wall of the chamber 15 and directed upstream opposite the direction D. Other such burners could be provided in the floor and/or walls of the reheating chamber 15.

Ambient air is taken in at 9 and fed through a heat-exchanger surrounding a stack 11 that opens at the upstream end of the chamber 15. A fan 17 sucks hot combustion-product gases out of the chamber 15 and through the stack 11 so that the heat of these waste gases can be transferred to the air in the heat exchanger 10. This heats this air to at least 600° C., so that it can be fed via the branched conduit 12 to the burners 4A, 4B, and 4C. The combination of the oxygen-containing air and the CO-containing top gases will burn extremely well, making a flame at about 1800° C.

If the air cannot be heated enough by heat exchange, it may also be heated by means of another plasma torch 14 provided in the heat exchanger 10 or in a separate chamber in the conduit 12. This torch 14, like the torches 7, is a standard cold-electrode plasma torch.

Heating the top gases by means of the plasma torches is particularly advantageous in this type of system since the CO is instable at temperatures of 500° C.–700° C., at which temperatures carbon deposits can form. Thus the temperature is kept high.

EXAMPLE

An apparatus as described above was operated in accordance with the following:

| | |
|---|---|
| Output | 200 tons/hr |
| Ingot temperature at exit 3 | 1200° C. |
| Top-gas feed rate to heater 6 | 80,000 $Nm^3/hr$ |

-continued

| | |
|---|---|
| Temperature gas heated to in 6 | 850° C. |
| Air feed rate to chamber 15 | 90,000 $Nm^3/hr$ |
| Temperature air heated to in 10 | 600° C. |
| Waste gases withdrawn through 11 | 120,000 $Nm^3/hr$ |
| Temperature of gases in 11 | 900° C. |
| Total power of torches 7 | 30 megawatt. |

With such a system it was possible to reduce the energy costs by about 25%, per ton of reheated metal bodies. Such a saving is substantial and well worth realizing. In addition this system safety disposes of the top gases from the furnace 16, which gases contain CO and other pollutants.

We claim:

1. A method of reheating metal bodies such as billets and blooms before rolling same in a metal-refining operation having a blast furnace, the method comprising the steps of:

heating the top gas of the blast furnace to at least 800° C. by means of a plasma torch;

burning the heated top gas in a reheating chamber; and exposing the metal bodies in the reheating chamber to the heat of the burning and heated top gas.

2. The reheating method defined in claim 1 wherein the heated top gas is mixed with combustion-inducing gas to burn it, the method further comprising the steps of withdrawing combustion-product gas from the reheating chamber; and prior to mixing the withdrawn combustion-product gas with the heated top gas, preheating the combustion-inducing gas by heat exchange with the withdrawn combustion-product gas.

3. The reheating method defined in claim 2 wherein the combustion-inducing gas is heated to at least 600° C.

4. The reheating method defined in claim 2 wherein the combustion-inducing gas is ambient air.

5. The reheating method defined in claim 1 wherein the heated top gas is mixed with combustion-inducing gas to burn it, the method further comprising the step of prior to mixing the combustion-inducing gas with the heated top gas, preheating the combustion-inducing gas by means of a plasma torch.

6. The reheating method defined in claim 1 wherein the bodies are exposed in the chamber by being passed in a transport direction through the chamber.

7. The reheating method defined in claim 6 wherein the burning heated top gas is directed as a flame at the bodies countercurrent to the transport direction of same.

8. The reheating method defined in claim 7, further comprising the step of withdrawing combustion-product gas from the preheating chamber from the upstream end thereof relative to the transport direction of the bodies.

* * * * *